US005784901A

United States Patent [19]

Yanase et al.

[11] Patent Number: 5,784,901

[45] Date of Patent: Jul. 28, 1998

[54] WASHING MACHINE

[75] Inventors: Shuji Yanase, Motosu-gun; Toshihiro Tamura, Moriyama; Shigeki Yoshida, Otsu; Takuya Noro, Otsu; Naoki Kitayama, Otsu; Masakazu Matsumoto, Kusatsu, all of Japan

[73] Assignee: Sanyo Electric Co., Ltd., Osaka, Japan

[21] Appl. No.: 694,507

[22] Filed: Aug. 7, 1996

[30] Foreign Application Priority Data

Aug. 31, 1995 [JP] Japan ..... 7-224363

[51] Int. Cl.[6] ..... D06F 31/00

[52] U.S. Cl. ..... 68/27; 68/131; 68/134

[58] Field of Search ..... 68/26, 27, 131, 68/134

[56] References Cited

U.S. PATENT DOCUMENTS

| | | | |
|---|---|---|---|
| 1,754,626 | 4/1930 | Holzhausen | 68/134 |
| 2,596,980 | 5/1952 | Castner | 68/131 X |
| 2,677,260 | 5/1954 | Castner | 68/131 |
| 2,757,065 | 7/1956 | Castner | 68/131 X |

FOREIGN PATENT DOCUMENTS

| | | | |
|---|---|---|---|
| 63-10152 | 3/1988 | Japan . | |
| 5-84199 | 1/1990 | Japan . | |
| 6-277386 | 10/1994 | Japan . | |
| 846113 | 8/1960 | United Kingdom | 68/26 |

*Primary Examiner*—Philip R. Coe

*Attorney, Agent, or Firm*—Beveridge, DeGrandi, Weilacher & Young,LLP

[57] ABSTRACT

A washing machine according to the present invention is a new washing machine which is compact and can realize uniform and good washing. The plane shape of a washing tub 211 is an approximately rectangular inner shape which is defined by a bottom 213, a pair of long side walls 214*a* and 214*b*, and a pair of short side walls 215*a* and 215*b*. A pulsator 212 is so provided on the one long side wall 214*b* out of the pair of long side walls that its center axis 219 is perpendicular to the long side wall 214*b*. The diameter A of a disk 220 of the pulsator 212 is so set that W<A. Further, a projection 221 of the pulsator 212 is a projection which is long in the radial direction of the disk 220, so that the height thereof from the surface of the disk 220 is large on the side of the circumference of the disk 220. In the washing machine, the pulsator 212 is increased in the efficiency of agitation of wash water and laundry in the washing tub 211 while being longitudinally arranged.

16 Claims, 9 Drawing Sheets

WASHING MACHINE

BACKGROUND OF THE INVENTION

1. Field of the Invention

The present invention relates to a washing machine. More particularly, it relates to a washing machine in which a pulsator for agitating wash water and laundry is provided on a side-face of a washing tub. Further, it relates to a washing machine containing such a washing tub and a fully automatic washing unit in one cabinet and capable of doing separate washing.

2. Description of the Related Art

A twin type washing machine comprising a fully automatic washing unit and a washing only unit has been known. The twin type washing machine is so constructed that a main washing unit, in which a basket (an inner tub) rotated with laundry contained therein is provided in a tub (an outer tub) accumulating wash water, and a pulsator for agitating the laundry and the wash water is further provided in the basket, capable of washing, rinsing and dehydrating the laundry and a sub-washing unit, in which a pulsator is provided on a bottom of a single tub, similarly to the main washing unit, of such a type that laundry is washed and rinsed and is not dehydrated are provided in one cabinet.

In the twin type washing machine, each of the main washing unit and the sub-washing unit has an approximately square plane shape, therefore, when the washing units are arranged adjacent to each other, there occurs a useless space. An attempt to cause the washing machine to have sufficient detergency increases the dimensions of the entire washing machine, and particularly increases the width thereof.

As an auxiliary washing tub which is combined with a fully automatic washing machine, a washing tub so constructed as to have a pulsator mounted on its side wall has been proposed (for example, Japanese Unexamined Patent Publication No. 6-277386/1994 of the present applicant).

When the washing machine is so constructed that a pulsator is provided on a side wall of a washing tub, that is, the center axis of the pulsator is arranged in the transverse direction, the shape of the washing tub, for example, can be made different from that in the conventional washing machine. Therefore, it is possible to realize a relatively small washing machine which has been conventionally infeasible and a washing machine which can be also arranged in a narrow place.

SUMMARY OF THE INVENTION

The present invention has been made under such a conception and has for its principal object to provide a new washing machine which is compact and can realize uniform and good washing.

Another object of the present invention is to provide a washing machine which can be miniaturized and can do separate washing.

Still another object of the present invention is to provide a convenient washing machine to use which can do separate washing.

In accordance with one aspect of the present invention, the washing machine is provided with a washing tub having a pair of long side walls and a pair of short side walls, and the plane shape thereof being an approximately rectangular inner shape comprising a pair of long sides D defined by said pair of long side walls and a pair of short sides W defined by said pair of short side walls, and a pulsator being so provided on one of the pair of long side walls that the center axis is perpendicular to the long side wall, where the diameter A of the disk of the pulsator being so set that W<A, as compared with the length W of said short side W.

According to this construction, the diameter A of a disk of a pulsator is so set that W<A, as compared with the width W of a short side wall (the length of a short side W) of a washing tub. That is, the pulsator is a considerably large pulsator. Therefore, wash water and laundry in the washing tub can be uniformly agitated by rotating or turning the pulsator. Since the pulsator is large, the wash water and the laundry can be satisfactorily agitated even if the pulsator is rotated at a relatively low rotational speed.

The projections of the pulsator may respectively be projections which are long in the radial direction of a disk, and the height thereof from the surface of the disk may be larger on the side of the circumference of the disk.

According to this construction, agitating flow having a large diameter can be caused at the time of agitation, whereby it is possible to increase the efficiency of agitation.

Each projection of the pulsator may be a projection directed toward the center axis from the circumference of the disk, and is formed in such a shape that the height thereof from the surface of the disk is gradually increased and gradually decreased from the circumference of the disk toward the center axis.

According to this construction, projections of a pulsator are in a so-called conical projections whose centers are raised as viewed in the radial direction of the disk, thereby causing efficient rotating flow. Therefore, the pulsator can agitate wash water and laundry.

In accordance with another aspect of the present invention, a defined water level for defining the amount of wash water accumulated in the washing tub is set, and the pulsator may be so provided that the center axis is positioned in the vicinity of the center between the bottom and the defined water level in the height direction on said one long side wall.

According to this construction, the distance from the center axis of a pulsator to its bottom below the center axis and the distance from the center axis to a defined water level above the center axis are approximately equal to each other, whereby wash water and laundry can be efficiently rotated or turned around the pulsator, thereby improving a washing effect.

Further, the dimensions of said washing tub may be so set that a length along said one long side wall on which the pulsator is provided from one end of the one long side wall as horizontally viewed to the center axis of the pulsator is approximately equal to a length from the other end of the one long side wall as horizontally viewed to the center axis of the pulsator.

According to this construction, a pulsator is provided in the center of a washing tub as viewed not only vertically but also horizontally. Consequently, the pulsator is rotated, whereby wash water and laundry in the washing tub can be well rotated around the pulsator.

A connecting portion between the bottom and the short side wall of said washing tub may be a recessed and curved surface.

According to this construction, connecting portions between a bottom and short side walls are recessed and curved surfaces allowing for the rotational direction of wash water and laundry, whereby laundry is well rotated at the time of washing.

Further, a connecting portion between at least the other long side wall, on which the pulsator is not provided, out of said pair of long side walls and the bottom may be a recessed and curved surface.

According to this construction, laundry is more smoothly rotated.

A plurality of recesses or projections extending in the longitudinal direction may be formed on the other long side wall, on which the pulsator is not provided, out of said pair of long side walls.

According to this construction, laundry rotated in the washing tub at the time of washing is rubbed against irregularities on the long side wall, whereby it is possible to improve the washing effect. Further, recesses or projections on the long side wall vertically extend. When the washing tub is integrally formed of resin, for example, therefore, the formation is easy.

A drainage port for draining the wash water in the washing tub may be formed in the lowermost part of said bottom.

According to this construction, wash water is smoothly drained off.

In accordance with another aspect of the present invention, the pulsator has its center axis passing through the long side wall in a direction perpendicular to the long side wall, a pulley rotatably provided coaxially with the center axis of the pulsator extending outward from the washing tub after passing through the long side wall is connected to the center axis, a motor having an output shaft is mounted on the lower side of the bottom of the washing tub, and a belt for transmitting the rotation of the output shaft of the motor to the pulley may be stretched between the output shaft and the pulley.

According to this construction, when wash water is put in the washing tub, the washing tub slightly extends so that a bottom of the washing tub is distorted downward due to the weight of the wash water. At this time, the motor is mounted on the lower side of the bottom of the washing tub, whereby the motor is also slightly displaced downward. The displacement increases the tension of the belt stretched between the motor and the pulley. Therefore, the tension of the belt is increased at the time of washing, so that the belt hardly slips. Consequently, the power of the motor is efficiently transmitted to the pulsator.

The motor may be slidably provided along the bottom, and the position where the motor is mounted may be displaced along the bottom surface, to change the distance between the output shaft and the pulley so that the tension of the belt may be adjustable.

According to this construction, the motor is displaced along the bottom of the washing tub, whereby the tension of the belt is easy to adjust.

In accordance with another aspect of the present invention, the washing machine having said washing tub and said pulsator is a first washing unit, in addition thereto, a second washing unit arranged adjacent to the first washing unit and comprising a washing tub for containing wash water and laundry, and a cabinet containing the first washing unit and the second washing unit may be provided.

According to this construction, it is possible to decrease the external dimensions of the washing machine capable of doing separate washing.

The second washing unit may be arranged adjacent to the long side, on which the pulsator is provided, of the first washing unit.

According to this construction, a space defined between the washing tub in the first washing unit and the washing tub in a second washing unit in the cabinet is partially shared by both the washing units. A part of a driving mechanism in the first washing unit is arranged in the shared space, whereby the shared space can be effectively utilized. Further, the space where the driving mechanism is provided can be reduced in the first washing unit. Consequently, the first washing unit can be decreased in external dimensions while having sufficient detergency. As a result, it is possible to decrease the external dimensions of the washing machine.

On the other hand, the second washing unit may be arranged adjacent to the long side on the opposite side of the long side, on which the pulsator is provided, of the first washing unit.

According to this construction, in a space defined between the washing tub in the first washing unit and the washing tub in the second washing unit in the cabinet, a driving mechanism for the first washing unit is not arranged. Therefore, the space can be reduced, so that the distance between both the washing tubs can be decreased. Consequently, it is easy to move laundry between both the washing tubs.

When the pulsator is rotated in water accumulated in the washing tub in the first washing unit, the water in the washing tub is splashed, whereby the splash of the water is carried about toward the opposite side of the long side on which the pulsator is provided. According to the above construction, however, the second washing unit is provided in the direction in which the splash is carried about, whereby a floor, a wall surface or the like in the direction and the pulsator can be separated from each other. As a result, it is difficult for the splash to reach the floor, the wall surface or the like, whereby it is possible to prevent the water from being splashed.

Further, a protecting member which can be brought into contact with the second washing unit and is not brought into contact with the first washing unit may be provided between the first washing unit and the second washing unit in the cabinet.

According to this construction, even when the second washing unit vibrates at the time of its operation, the protecting member can prevent the second washing unit from being brought into contact with the first washing unit, whereby it is possible to protect the washing units.

The washing tub in the second washing unit may be so constructed as to be rotated with the laundry and the wash water contained therein, and comprises a plurality of suspension bars for mounting the washing tub in said second washing unit on the cabinet, a portion, which is mounted on the cabinet, of the suspension bar being closer to the first washing unit than a portion, which is closest to the second washing unit, of the first washing unit.

According to this construction, when the external dimensions of the cabinet are made equal to those of the conventional cabinet, suspension bars can be mounted on the cabinet with larger mounting spacing than the conventional mounting space, whereby the second washing unit can be stably supported. On the other hand, when the suspension bars are mounted with the same mounting spacing as the conventional mounting space, the external dimensions of the cabinet can be made smaller than those of the conventional cabinet.

In accordance with another aspect of the present invention, the washing tub in the second washing unit may be so constructed as to have in its upper part an opening larger than the opening in the upper part of the first washing unit, the first washing unit being arranged on the right side in the cabinet as viewed from the front surface of the cabinet.

According to this construction, even when a left side-face of the cabinet is brought near a wall surface or the like of a room, so that the wall surface or the like approaches the second washing unit, laundry can be easily taken in and out because the opening in the upper part of the second washing unit is large. On the other hand, even when a right side-face of the cabinet is brought near the wall surface or the like of the room, so that the wall surface or the like approaches the first washing unit, a user can easily take laundry in and out with his or her right hand because the opening in the upper part of the first washing unit is positioned on the right side of the cabinet. Consequently, the washing machine is convenient for a right-handed person to use even when it is located in a narrow place.

The foregoing and other objects, features, aspects and advantages of the present invention will become more apparent from the following detailed description of the present invention when taken in conjunction with the accompanying drawings.

DETAILED DESCRIPTION OF SOME EMBODIMENTS

Figure 1:
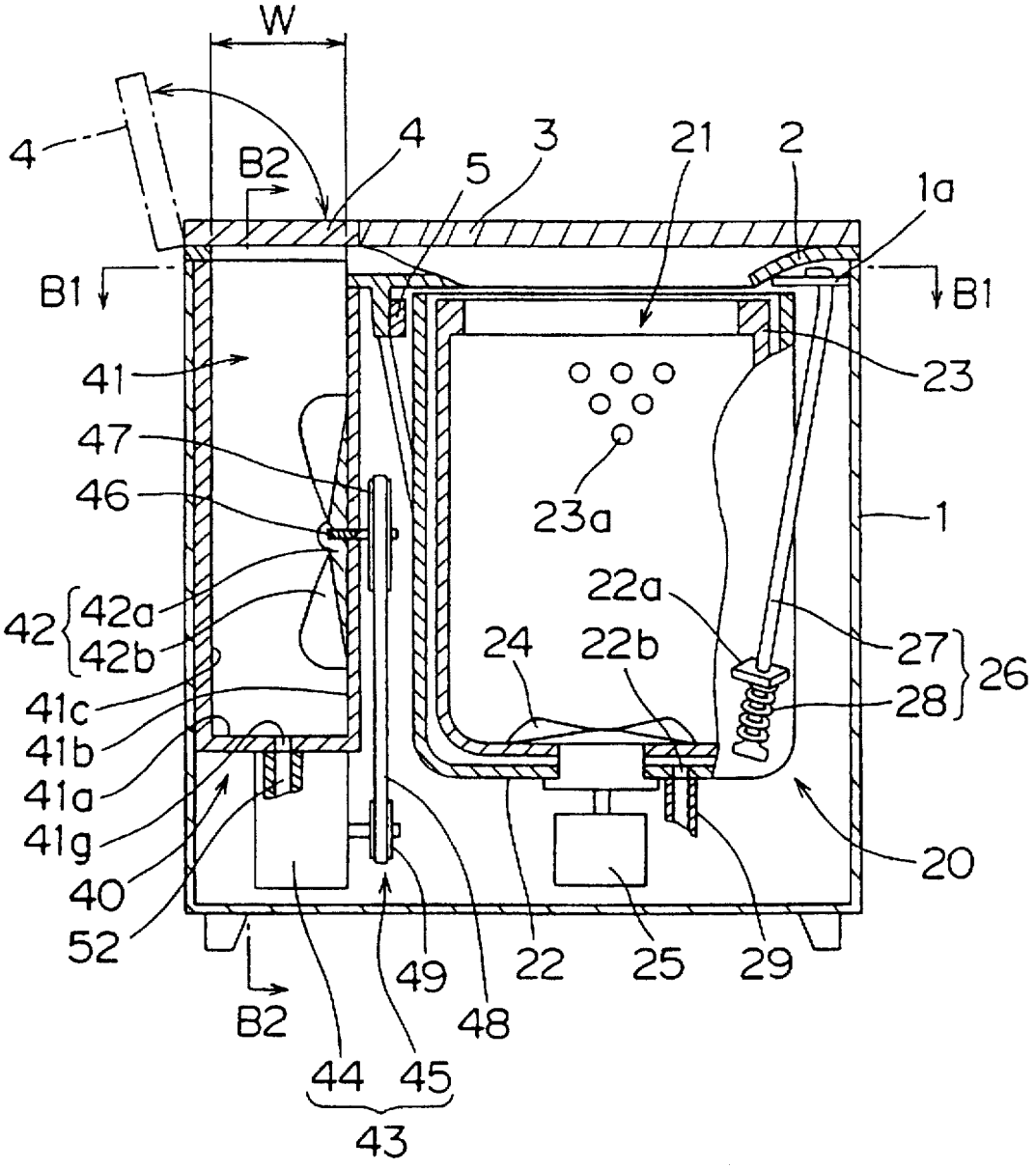
FIG. 1 is a sectional front elevation showing the schematic construction of a washing machine according to a first embodiment of the present invention.
Figure 2:
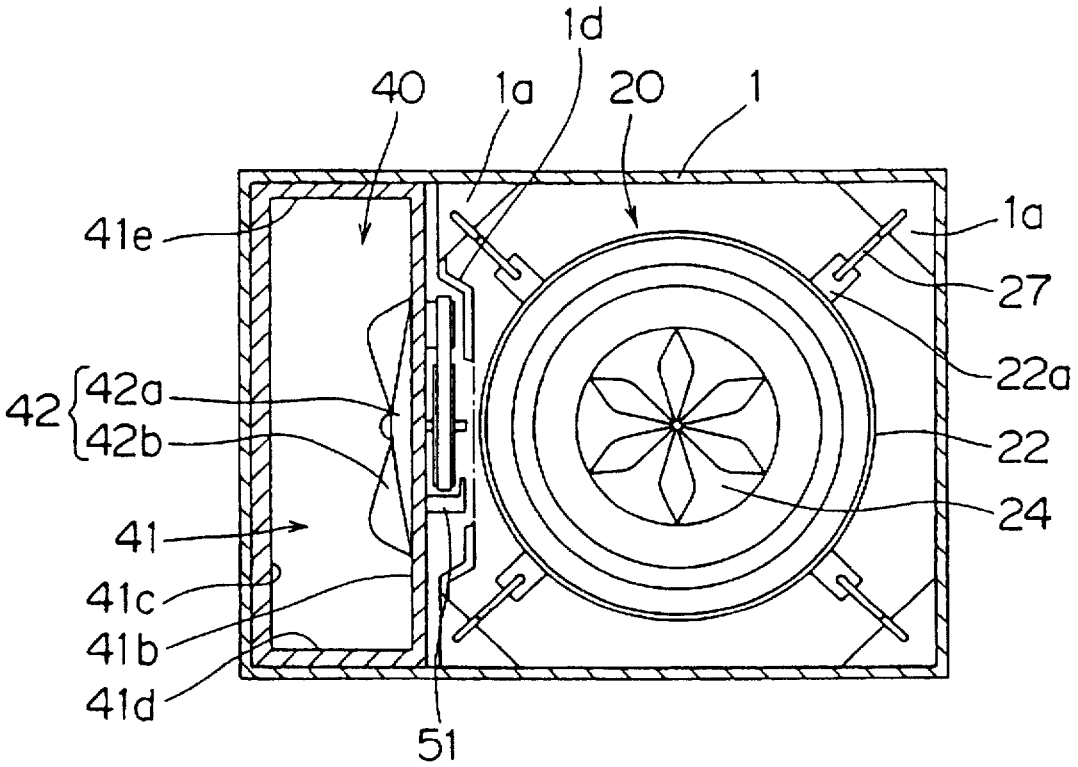
FIG. 2 is a sectional plan view showing the schematic construction of the washing machine shown in FIG. 1, which illustrates a cross section taken along a one-dot and dash line B1 shown in FIG. 1.
Figure 3:
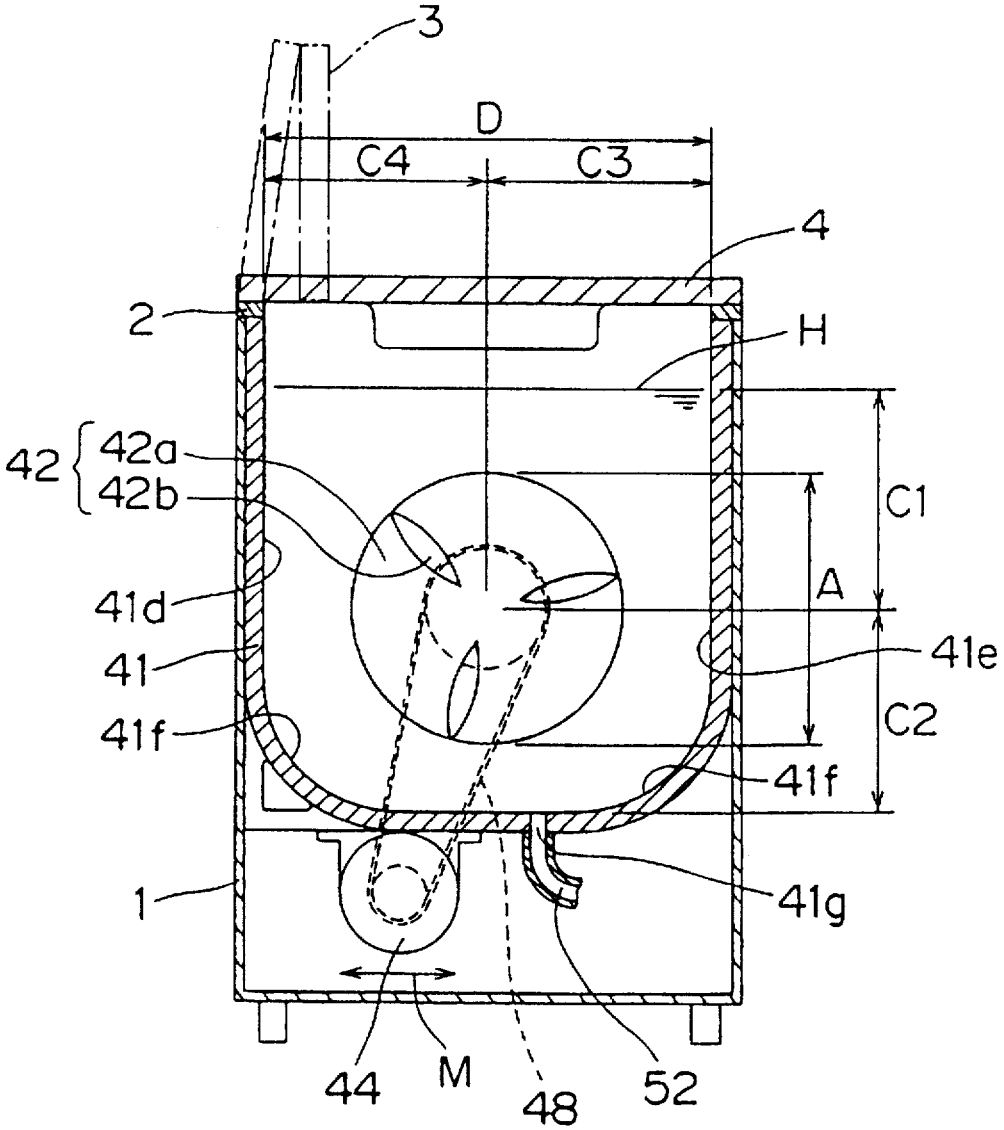
FIG. 3 is a sectional side elevation showing the schematic construction of the washing machine shown in FIG. 1, which illustrates a cross section taken along a one-dot and dash line B2 shown in FIG. 1.

FIG. 1 is a sectional front elevation showing the schematic construction of a washing machine according to a first embodiment of the present invention. FIG. 2 is a sectional plan view showing the washing machine shown in FIG. 1. FIG. 3 is a sectional side elevation showing the washing machine shown in FIG. 1. Here, the side of the position where a user stands at and operates the washing machine is defined as the front.

The entire construction will be first described.

Referring to FIGS. 1 and 2, the washing machine comprises a rectangular plane-shaped cabinet 1 for determining its outer shape and having, for example, long sides extending in the lateral direction and short sides extending in the longitudinal direction, a main washing unit 20 contained in the cabinet 1, a sub-washing unit 40 arranged in the cabinet 1 adjacent to the main washing unit 20, and a control section (not shown) for controlling the main washing unit 20 and the sub-washing unit 40. The control section can independently operate the main washing unit 20 and the sub-washing unit 40, respectively, and can do separate washing corresponding to laundry.

The main washing unit 20 has approximately the same construction as that of the known fully automatic washing machine as described later, and can wash, rinse and dehydrate the laundry by a command from the control section. The main washing unit 20 is arranged in a large portion of the cabinet 1 on the right side thereof as viewed from the top, for example, an approximately square portion which has as its one side a short side of the plane shape of the cabinet 1.

The sub-washing unit 40 can wash and rinse the laundry, as described later. The sub-washing unit 40 is arranged in a portion other than the portion occupied by the main washing unit 20, for example, a rectangular portion extending in the longitudinal direction which has as its long side the short side of the plane shape of the cabinet 1 on the left side thereof as viewed from the top, and is so set as to be lower in capacity than the main washing unit 20.

The cabinet 1 is formed in a box shape, and has a crosspiece-shaped reinforcing member 1*d* stretched from its front surface to its rear surface provided in its upper part and between the portion where the main washing unit 20 is arranged and the portion where the sub-washing unit 40 is arranged. A mounting collar 1*a* for mounting the main washing unit 20 is provided at each of corners between the reinforcing member 1*d* and front and rear side-faces of the cabinet 1 and between the front and rear side-faces and a right side-face of the cabinet 1.

Furthermore, the cabinet 1 comprises an upper panel 2 forming the upper surface of the cabinet 1 and defining two openings opened upward of both the washing units. The upper panel 2 comprises a recess so formed as to be lower than the other portion between the two openings in order to make it easy to move the laundry between both the washing units.

The washing machine further comprises a cover 3 covering the opening of the main washing unit 20 and a cover 4 covering the opening of the sub-washing unit 40 on the upper panel 2.

The cover 4 is formed in a rectangular shape which is approximately equal to the plane shape of the portion where the sub-washing unit 40 is provided and extends in the longitudinal direction, and is so mounted that it can be opened and closed using as its center of rotation a rotary axis horizontally extending along a left side-face of the cabinet 1 with the long side of the cover 4 along a left end of the upper surface of the cabinet 1 (its opened state is indicated by a one-dot and dash line in FIG. 1). The cover 4 in the opened state can be maintained in a state where it is raised on the upper panel 2. The cover 4 opened in the raised state at an end of the cabinet 1 can thus constitute a wall between both the washing units and the outside of the washing machine, whereby wash water can be prevented from being scattered outward from the washing machine when the laundry is moved between both the washing units. Since the center of rotation for opening or closing of the cover 4 is along the long side of the cover 4, the cover 4 only requires an opening or closing space in the height direction having the length of its short sides at the time of opening and closing, whereby it is possible to reduce the opening or closing space in the height direction.

The above-mentioned cover 3 is formed in an approximately square shape which is approximately equal to the plane shape of the portion where the main washing unit 20 is provided, and is so mounted that it can be opened and closed with its one side along a rear end of the upper surface of the cabinet 1 using as its center of rotation its axis horizontally extending along the rear end and it is foldable in its center parallel to the axis (its opened state is indicated by a one-dot and dash line in FIG. 3). Since the cover 3 is foldable, therefore, an opening or closing space in the height direction can be reduced. When a clothes drier or the like is located above the washing machine, therefore, the clothes drier can be made convenient of use in cooperation with the opening or closing space which is small in the height direction of the cover 4.

Description is now made of the main washing unit 20.

The main washing unit 20 comprises a washing tub 21 for washing the laundry with the wash water and the laundry contained therein, a plurality of, for example, four suspension bars 26 for mounting the washing tub 21 in the cabinet 1, a water supplying mechanism (not shown) for supplying the wash water to the washing tub 21, and a draining mechanism including a drainage pipe 29 for draining the wash water from the washing tub 21.

The above-mentioned washing tub 21 comprises an tub 22 in which the wash water can be accumulated, a basket 23 rotatably provided in the tub 22, containing the laundry, and having a lot of small holes 23*a* provided on its surface, a pulsator 24 positioned at the bottom of the basket 23, having a disk shape, and having projections formed on its upper surface for agitating the laundry and the wash water in the basket 23, and a driving device 25 for driving the pulsator 24 and the basket 23. The driving device 25 comprises a motor, a bearing, a clutch, and the like for rotating only the pulsator 24 in one direction or in both directions at the time of washing and rinsing, while rotating both the pulsator 24 and the basket 23 at high speed in one direction at the time of dehydration. The wash water after the washing and dehydration is drained outward from the washing machine through the drainage pipe 29 connected to a drainage port 22*b* formed on the bottom surface of the tub 22.

Each of the above-mentioned suspension bars 26 comprises a supporting bar 27 and a spring 28 for connecting a mounting seat 22*a* provided in a lower part of the tub 22 and the mounting collar 1*a* provided in the upper part of the cabinet 1 to each other. The supporting bar 27 has its upper end suspended by the mounting collar 1*a* and its lower end passing through the mounting seat 22*a*. The spring 28 is provided between the lower end of the supporting bar 27 and the mounting seat 22*a* in order that the supporting bar 27 passing through the mounting seat 22*a* is mounted therein. The suspension bars 26 can thus restrain the vibration of the washing tub 21 at the time of the rotation of the pulsator 24 and the basket 23, and can restrain the vibration of the cabinet 1.

Description is now made of the sub-washing unit 40 referring to FIG. 3.

The sub-washing unit 40 comprises a washing tub 41 having an approximately rectangular inner shape for containing the wash water and the laundry, a pulsator 42 provided on a long side wall of the washing tub 41 and capable of agitating the laundry and the wash water, and a driving mechanism 43 for driving the pulsator 42. The pulsator 42 further comprises a disk 42*a* rotated or turned around a rotary axis 46 which is a center axis horizontally extending, and projections 42*b* provided on the surface of the disk 42*a*. The wash water and the laundry in the washing tub 41 are agitated by the pulsator 42 as described later, whereby the laundry is washed by the flow of water and rubbing against the pulsator 42 and an inner surface of the washing tub 41, and is rinsed in the same manner.

The washing tub 41 comprises a bottom 41*a*, and a pair of long side walls 41*b* and 41*c* opposite to each other and a pair of short side walls 41*d* and 41*e* opposite to each other which are side walls raised from the circumference of the bottom 41*a*. The plane shape of the washing tub 41 is an approximately rectangular shape defined by the side walls and comprising a pair of long sides D (a length D) defined by the pair of long side walls and a pair of short sides W (a length W) defined by the pair of short side walls. The washing tub 41 is so provided as to extend in the longitudinal direction with the long side of the rectangle along the left side-face of the cabinet 1.

A defined water level H for defining the amount of wash water accumulated in the washing tub 41 is set therein. The defined water level H is so set as to correspond to an amount of wash water which is accumulated enough in the washing tub 41 to agitate the laundry with the wash water, for example, so set that the center axis of the pulsator 42 is positioned in the vicinity of the center between the defined water level H and the bottom 41*a* in the height direction.

A connecting portions 41*f* between the bottom 41*a* and the short side walls 41*d* and 41*e* are formed into a recessed and curved surface, for example, a circumferential surface having an approximately equal diameter to the diameter of the pulsator 42. Consequently, the bottom 41*a* can smoothly guide the flow of water caused by the rotation of the pulsator 42, and can maintain the washing effect without weakening the flow of water. Further, the laundry can be agitated by the pulsator 42 without staying in the washing tub 41.

The pulsator 42 is provided on the one long side wall 41*b* nearer the main washing unit 20 out of the pair of long side walls so that the rotary axis 46 is perpendicular to the long side wall 41*b*.

The center position of the disk 42*a* is set in the following manner. That is, the center position is so set that a length C3 from one end (a front end) of the long side 41*b* as horizontally viewed to the center axis of the pulsator 42 is approximately equal to a length C4 from the other end (a rear end) of the long side 41*b* as horizontally viewed to the center axis of the pulsator 42, and a length C2 from the bottom 41*a* as vertically viewed to the center axis of the pulsator 42 is approximately equal to a length C1 from the defined water level H as vertically viewed to the center axis of the pulsator 42 along the long side wall 41*b* on which the pulsator 42 is provided, or $C1 \doteq C2$ and $C3 \doteq C4$. The center position may be so set that $C1 \doteq C2 \doteq C3 \doteq C4$.

Furthermore, the diameter A of the disk 42*a* is so set that $W<A$.

The diameter A of the disk 42*a* is thus so set that $W<A$, whereby the distance between the pulsator 42 and the opposite long side wall 41*c* is restricted. Therefore, the laundry in the washing tub 41 is not widely separated from the pulsator 42, and is brought into sufficient contact with the pulsator 42. Further, the flow of water caused by the pulsator 42 can sufficiently strike the laundry. Consequently, it is possible to enhance the effects of agitating and washing the laundry by the flow of water and rubbing against the pulsator 42. Further, the laundry can be thoroughly agitated by the pulsator 42. Therefore, the rotational speed of the pulsator 42 can be set to a lower rotational speed than 700 to 800 RPM in the conventional jet-type washing machine, for example, 190 to 300 RPM, preferably 200 to 260 RPM, whereby cloth can be prevented from being worn out.

When the diameter A of the disk 42*a* is so set that W<A<0.7 D, the laundry can be also fully contained in a space on the side of the outer periphery of the pulsator 42. The laundry contained in the space on the side of the outer periphery is rotated along with the laundry moved within the washing tub 41 while being in contact with the pulsator 42, and is agitated while being rubbed against the inner surface of the washing tub 41.

The above-mentioned projections 42*b* are arranged uniformly in several positions, for example, three positions at a peripheral edge of the disk 42*a*, are high on the side of the circumference of the disk 42*a*, and are not formed in the center of the disk 42*a*. Consequently, the projections 42*b* can agitate a wide portion as the pulsator 42 is rotated, whereby it is possible not only to enhance the effects of agitating and washing the laundry but also to less tangle the cloth, as compared with a case where the projections 42*b* are high to the center of the disk 42. The center of the disk 42*a* on the figure is raised so as to contain the rotary axis 46, and is not for agitation. The projections 42*b* may be extended to the center of the disk 42*a*, as required.

The driving mechanism 43 is provided along an outer surface to a bottom of the long side 41*b* in the cabinet 1 outside the washing tub 41, and comprises a motor 44 for driving the pulsator 42 and a transmitting mechanism 45 for transmitting the rotation of the motor 44.

The transmitting mechanism 45 comprises the above-mentioned rotary axis 46 rotatably supported on the long side 41*b* of the washing tub 41 and having an axis passing through the center of the disk 42*a* provided perpendicularly to its plate surface, a large pulley 47 rotated integrally with the rotary axis 46, a belt 48 wound around the large pulley 47, and a small pulley 49 driving the belt 48 and rotated integrally with an output shaft of the motor 44. The rotation of the motor 44 is decelerated by the small pulley 49, the belt 48 and the large pulley 47, and is transmitted from the rotary axis 46 to the pulsator 42.

The motor 44 is slidably provided along the bottom of the washing tub 41. Since the tension of the belt 48 can be adjusted by displacing the position where the motor 44 is mounted along the bottom (in a direction indicated by an arrow M shown in FIG. 3) to adjust the distance between the output shaft of the motor 44 and the large pulley 47, the motor 44 can be easily assembled.

The motor 44 is driven at a predetermined number of revolutions, for a predetermined time, in one direction, or while being reversely rotated by the above-mentioned control section, and drives the pulsator 42 at a predetermined rotational speed, for example, the above-mentioned 190 to 300 RPM, preferably 200 to 260 RPM. Further, washing corresponding to the laundry can be done by adjusting the rotational speed. For example, hard washing due to the friction caused by strong flow of water and the pulsator 42 can be done by increasing the rotational speed. On the other hand, soft washing due to soft flow of water can be done at a low rotational speed.

Furthermore, the sub-washing unit 40 comprises a water supplying mechanism (not shown) for supplying wash water to the washing tub 41, so that the wash water is supplied to the above-mentioned defined water level H in the washing tub 41. The sub-washing unit 40 further comprises a draining mechanism including a drainage pipe 52 connected to a drainage port 41*g* formed in the lowermost part of the washing tub 41 in order to drain the wash water from the washing tub 41.

Related sections between the main washing unit 20 and the sub-washing unit 40 will be described.

The driving mechanism 43 in the sub-washing unit 40 is arranged in a space between the washing tub 41 and the washing tub 21 in the cabinet 1. This space is a portion formed in the boundary between both the washing units. Since the driving mechanism 43 is arranged in the space, the space efficiency of the space can be increased. Correspondingly, the external dimensions of the sub-washing unit 40 can be restrained. Consequently, the external dimensions of the washing machine can be also restrained. Further, the driving mechanism 43 and the main washing unit 20 are close to each other, which is convenient for maintenance of the washing machine.

Members in the main washing unit 20 can be also arranged in the above-mentioned space. For example, two positions on the left side of the above-mentioned mounting collar 1*a* are provided, closer to the sub-washing unit 40 than a portion, which is near the main washing unit 20, of the sub-washing unit 40, for example, a right end of the rotary axis 46 (on the left side of the right end of the rotary axis 46). Consequently, the space efficiency of the above-mentioned space can be increased. Correspondingly, the external dimensions of the main washing unit 20 can be restrained. Consequently, the external dimensions of the washing machine can be also further restrained. Further, the suspension bars 26 can stably support the washing tub 21 because they are mounted on the cabinet 1 having the same external dimensions as those of the conventional cabinet with larger mounting spacing than the conventional mounting space, whereby it is possible to improve the stability at the time of dehydration.

Furthermore, the washing machine comprises a protecting member 5 on the lower surface of the upper panel 2 between the main washing unit 20 and the sub-washing unit 40 in the cabinet 1. The protecting member 5 is a rubber piece provided, closer to the main washing unit 20 than a position which can be brought into contact with the washing tub 21 in the main washing unit 20 and is not brought into contact with the sub-washing unit 40, for example, the right end of the rotary axis 46 which is the portion, which is near the main washing unit 20, of the sub-washing unit 40. Even when the washing tub 21 thus vibrates at the time of operating the main washing unit 20 as described above, the washing tub 21 is brought into contact with the protecting member 5, whereby the amplitude of the vibration is restrained. Therefore, it is possible to prevent the washing tub 21 from being brought into contact with the sub-washing unit 40, and to protect respective sections in the sub-washing unit 40, for example, the transmitting mechanism 45 and the washing tub 41, and the washing tub 21. Although the protecting member 5 may be of any construction and of any material, provided that it can restrain the amplitude of the vibration of the washing tub 21. It is more preferable that the protecting member 5 is formed of a member having a cushioning function such as a rubber material because it can absorb shock at the time of the contact of the washing tub 21.

In the conventional washing machine doing separate washing, both a main washing unit and a sub-washing unit respectively comprise pulsators on their bottom. Therefore, the plane shape of a washing tub in each of the washing units becomes an approximately square shape, whereby the space efficiency is reduced. As a result, the width of the washing machine exceeds 750 mm, whereby the dimensions of the washing machine are unsuitable for domestic purposes.

On the other hand, according to the present embodiment, the washing machine is constituted by the main washing unit 20 in an approximately square plane shape and the sub-washing unit 40 having the washing tub 41 extending in the longitudinal direction. When both the washing units are contained in the single cabinet 1, therefore, good space efficiency is feasible. In addition thereto, the space between both the washing units is also effectively utilized, whereby it is possible to realize better space efficiency. Further, the sub-washing unit 40 has sufficient detergency because the laundry is agitated by the pulsator 42 provided on the side wall of the washing tub 41. Consequently, it is possible to realize a washing machine capable of doing separate washing which is preferable for domestic purposes.

Figure 9:
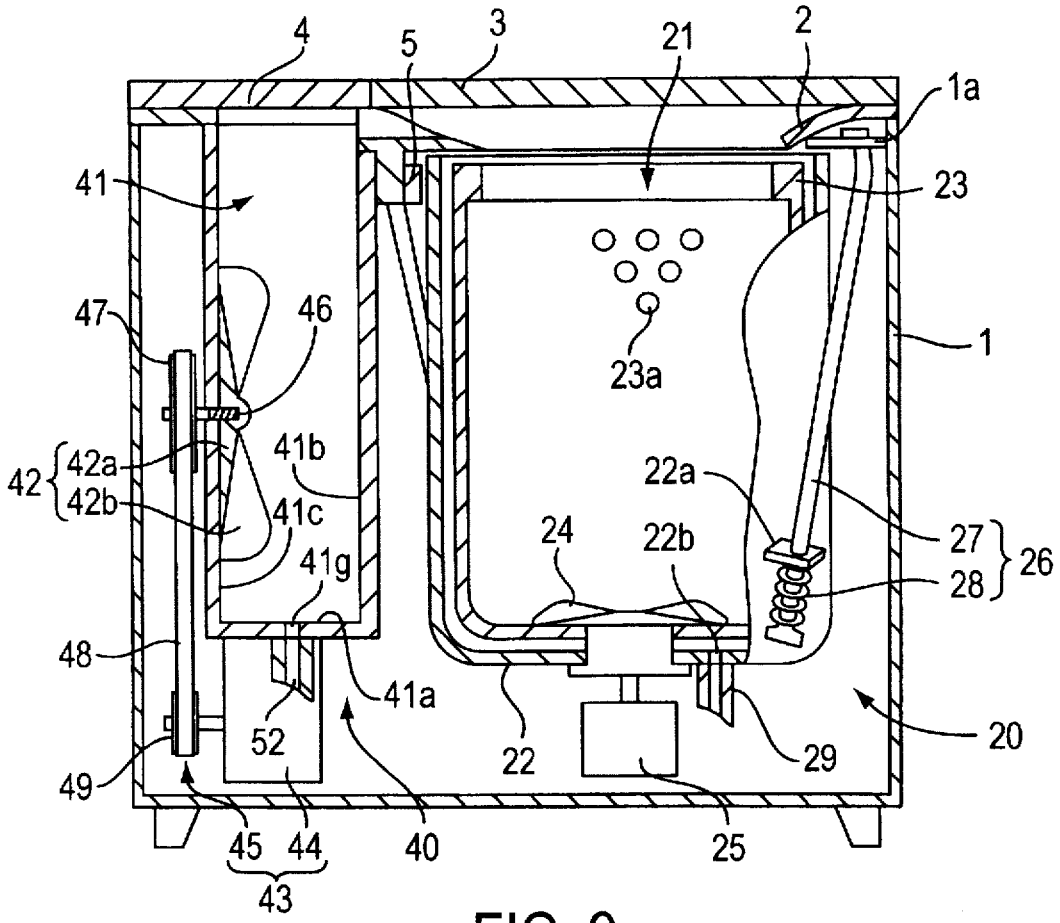
FIG. 9 is a sectional front elevation showing the schematic construction of a washing machine according to a fifth embodiment of the invention.

In place of the above-mentioned construction, the pulsator 42 in the sub-washing unit 40 may be arranged on the opposite long side wall 41*c* as shown in FIG. 9.

Specifically, the above-mentioned pulsator 42 may be provided on the one long side wall 41*c* farther away from the main washing unit 20 out of the pair of long side walls 41*b* and 41*c*.

In the construction of the sub-washing unit 40, the pulsator 42 may be thus arranged on the long side wall 41*c* farther away from the main washing unit 20 and correspondingly, the driving mechanism 43 may be provided farther away from the main washing unit 20 in the cabinet 1. In this case, the driving mechanism 43 is not arranged between the washing tub 41 and the washing tub 21. Consequently, the washing tub 41 can be brought near the washing tub 21, whereby the laundry can be easily moved between the washing tub 21 and the washing tub 41.

Furthermore, the driving mechanism 43 is arranged with the washing tub 41 interposed between the driving mechanism 43 and the washing tub 21. Even when the washing tub 21 vibrates at the time of operating the main washing unit 20, therefore, the washing tub 21 does not directly collide with the driving mechanism 43, whereby the driving mechanism 43 can be prevented from being damaged. Even if the washing tub 21 collides with the washing tub 41, the washing tub 41 functions as a cushioning member, and can absorb shock on the driving mechanism 43. If such a case is assumed, it is preferable that a member having good shock resistance is selected as the material of the washing tub 41.

Description is now made of a washing machine according to a second embodiment of the present invention.

Figure 4:
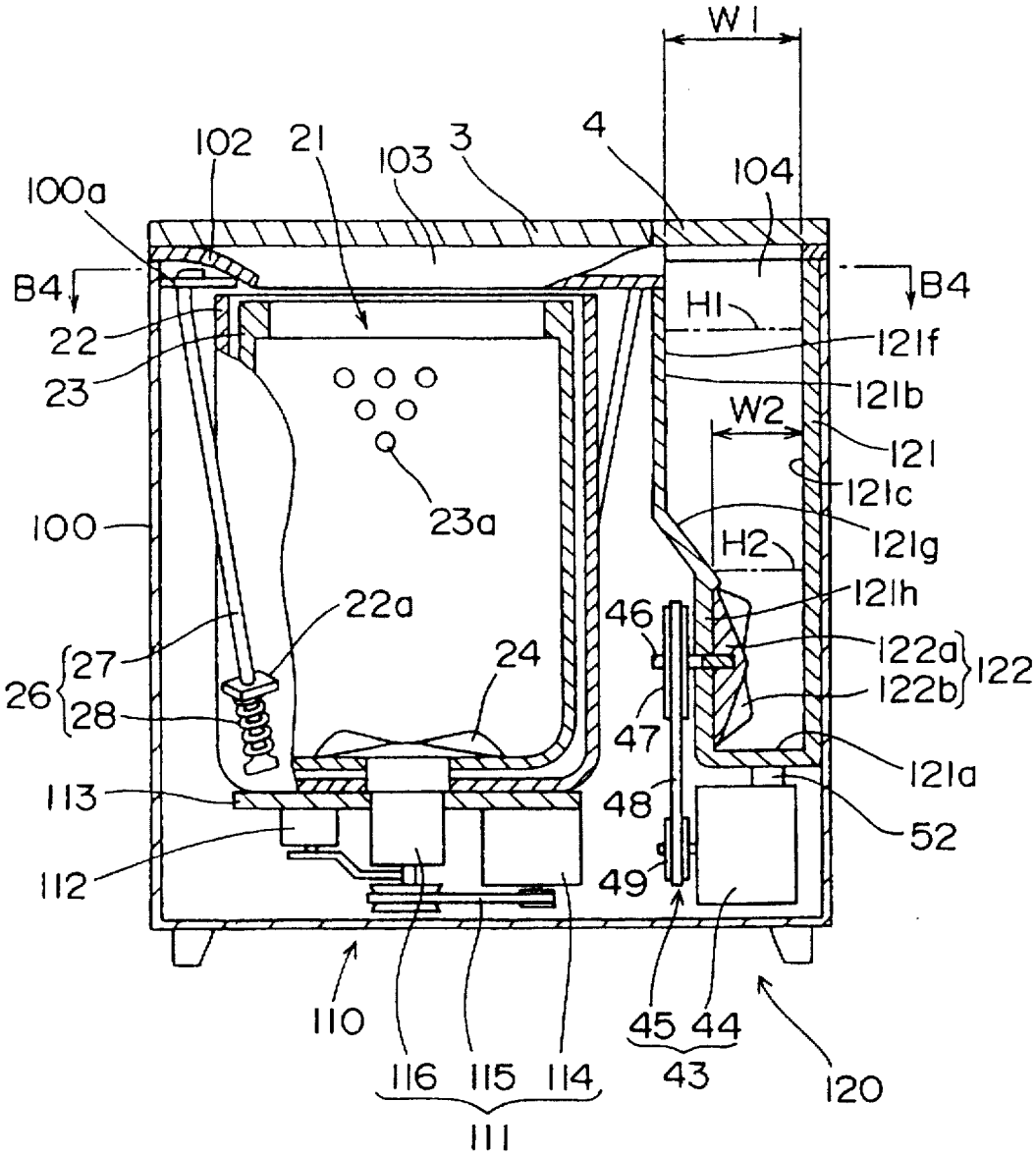
FIG. 4 is a sectional front elevation showing the schematic construction of a washing machine according to a second embodiment of the present invention.
Figure 5:
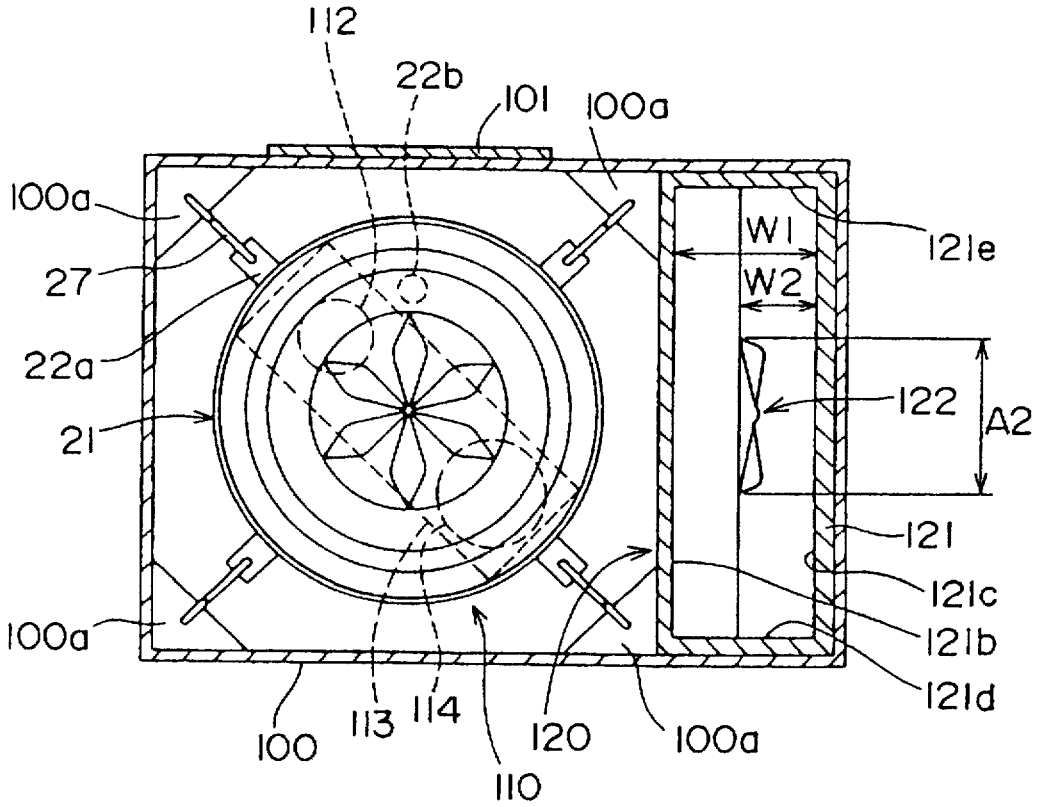
FIG. 5 is a partially sectional plan view showing the washing machine shown in FIG. 4, which illustrates a cross section taken along a one-dot and dash line B4 shown in FIG. 4.

FIG. 4 is a cross sectional front view showing the schematic construction of a washing machine according to a second embodiment. FIG. 5 is a partially sectional plan view showing the washing machine shown in FIG. 4, which illustrates a cross section taken along a one-dot and dash line B4 shown in FIG. 4. The washing machine according to the present embodiment differs in the following points from the washing machine according to the first embodiment. That is: a. The cabinet 1 is replaced with a cabinet 100. b. The main washing unit 20 is replaced with a main washing unit 110 which differ in the construction of a driving device. c. The sub-washing unit 40 is replaced with a sub-washing unit 120 which differ in a washing tub and a pulsator. d. In the cabinet 100, the main washing unit 110 and the sub-washing unit 120 are respectively arranged on the left side and the right side as viewed from the top. e. The protecting member 5 in the first embodiment is not provided. Different points will be described in detail. The same sections as those described in the first embodiment are assigned the same reference numerals.

The cabinet 100 will be first described.

The cabinet 100 is obtained by laterally inverting the inner arrangement of the cabinet 1 in the first embodiment in conformity to the foregoing item d. Specifically, the main washing unit 110 is mounted in the cabinet 100 on the left side thereof through a mounting collar 100*a* which is the same as the mounting collar 1*a*, and the sub-washing unit 120 is mounted in the cabinet 100 on the right side thereof as described above. The cabinet 100 comprises an upper panel 102 forming its upper surface. The upper panel 102 is constructed by laterally inverting the upper panel 2 described in the first embodiment, and has covers 3 and 4 provided on its upper part.

Furthermore, an opening 103 provided in an approximately square portion which has as its one side a short side of the plane shape of the cabinet 100, and an opening 104 provided in a rectangular portion extending in the longitudinal direction which has as its long side the short side of the plane shape of the cabinet 100 are formed in the upper panel 102 so as to respectively correspond to the main washing unit 110 and the sub-washing unit 120. For example, the opening 103 is formed into a circle having an approximately equal diameter to the length of the short side of the cabinet 100, and the opening 104 is formed into a rectangle having as its long side a side having a length approximately equal to the length of the short side of the cabinet 100. Since the opening 103 in the upper part of the main washing unit 110 is thus larger than the opening 104 in the upper part of the sub-washing unit 120 as viewed from the front, laundry can be easily taken in and out of the washing machine. Even when a left side-face on the side of the main washing unit 110 of the cabinet 100 is close to a wall surface of a room, for example, the convenience of use is not lost. Even when the wall surface, for example, is close to the sub-washing unit 120, so that it is difficult for a person to perform work standing on a front surface of the sub-washing unit 120, the opening 104 in the upper part of the sub-washing unit 120 is provided on the right side as described above even if it is relatively small as viewed from the front, whereby the person can easily take out the laundry through the opening 104 with his or her right hand. Consequently, the washing machine is convenient for a right-handed person to use. Therefore, the washing machine can be a washing machine which is convenient for more persons to use and can be located in a narrow place.

Furthermore, the cabinet 100 can select either one of its side-face and its rear surface and draws a drainage pipe (not shown) for introducing water drained from the main washing unit 110 and the sub-washing unit 120 out of the selected surface. Therefore, the cabinet 100 has an opening for maintenance (not shown) on its rear surface. The opening for maintenance is formed on the rear surface of the cabinet 100 and a portion behind the main washing unit 110. The opening for maintenance is generally closed by a cover 101, and is opened at the time of location and maintenance, so that the inside of the cabinet 100 can be opened.

The main washing unit 110 will be described.

The main washing unit 110 has the same construction as that of the known fully automatic washing machine. The main washing unit 110 comprises a driving device 111 for driving a pulsator 24 and a basket 23 and a drain valve 112 provided halfway in a drainage pipe (not shown) connected to a drainage port 22b for controlling the circulation of drained water at the bottom of an tub 22. The drain valve 112 is mounted integrally with the driving device 111 through a fixture 113. The fixture 113 is fixed to an outer bottom surface of the tub 22. This construction is the same as that disclosed in the prior application (Japanese Examined Patent Publication No. 5-84199/1993, for example).

The driving device 111 comprises a motor 114 serving as a driving source and a mechanism section 116 driven and transmitted from the motor 114 through a belt 115. The mechanism section 116 includes an opening or closing operation mechanism of a bearing, a clutch, and the drain valve 112, for example. The driving device 111 rotates the pulsator 24 and the basket 23 depending on the operating conditions, similarly to the driving device 25.

The mechanism section 116 is provided in the center of the outer bottom surface of the tub 22. The motor 114 and the drain valve 112 are arranged on both sides with the mechanism section 116 interposed therebetween as viewed from the top.

Furthermore, the drainage port 22b is provided near the opening for maintenance of the cabinet 100, for example, a portion near the rear of the tub 22 in order that it is possible to choose to draw the drainage pipe out of the cabinet 100 as described above. Further, the drain valve 112 is provided near the opening for maintenance, for example, on the left side of the rear of the cabinet 100 in order that a space inside the cabinet 100 near the sub-washing unit 120 is provided so as to make it easy to perform rotating work of the drainage pipe. As a result, the motor 114 is arranged at the front of the cabinet 100 near the sub-washing unit 120, and is provided near the center of the cabinet 100 as viewed from the top. The motor 114 which is a relatively heavy member is thus positioned near the center of the washing machine. Therefore, the stability of the washing machine is increased, as compared with that in a case where it is positioned farther away from the center, whereby it can be difficult for the washing machine to vibrate at the time of its operation.

Description is now made of the sub-washing unit 120.

In the sub-washing unit 120, the washing tub 41 in the sub-washing unit 40 in the first embodiment is replaced with a washing tub 121 which differ in the width in the height direction, and the pulsator 42 is replaced with a pulsator 122 having a smaller outer shape.

The washing tub 121 comprises a bottom surface 121a, a pair of long side walls 121b and 121c, and a pair of short side walls 121d and 121e. The one long side wall 121b near the main washing unit 110 out of the pair of long side walls has an upper portion 121f, an intermediate portion 121g, and a lower portion 121h which differ in spacing from the opposite long side wall 121c. The upper portion 121f of the long side wall 121b is formed of a vertical surface, and spacing W1 thereof from the long side wall 121c is relatively large. The lower portion 121h is formed of a vertical surface, and spacing W2 thereof from the long side wall 121c is smaller than the spacing W1. Further, the intermediate portion 121g is formed of an inclined surface smoothly connecting the upper portion 121f and the lower portion 121h to each other. The shape of the side wall of the washing tub 121 is the same as that of the washing tub 41.

The spacing W1 between the long sides in the vicinity of the opening 104 of the washing tub 121 is larger than the spacing W2 below the opening 104, whereby the laundry is easy to take out.

Furthermore, the pulsator 122 is provided in the lower portion 121h of the long side wall 121b with the lower part of the pulsator 122 close to the bottom 121a of the washing tub 121.

In the pulsator 122, each projection 122b is provided on the surface of a disk 122a having a smaller outer diameter than that of the pulsator 42. The diameter A2 of the disk 122a of the pulsator 122 is larger than the spacing W2 between the lower portion 121h of the long side 121b and the opposite long sides 121c, and is so set that W2<A2.

Furthermore, the diameter A2 of the pulsator 122 is made smaller than the diameter A of the pulsator 42 and correspondingly, is so set that W2<W. The width W2 of the washing tub 122 can be decreased by thus decreasing the diameter A2 of the pulsator 122. As a result, in the present embodiment, the sub-washing unit 120 can be made smaller than the sub-washing unit 40 in the first embodiment. Correspondingly, the external dimensions of the cabinet 100 can be made smaller. The width W1 is made approximately equal to the width W, whereby it is ensured that the laundry is easy to take out.

In the washing tub 121, a plurality of defined water levels at the time of washing are set. For example, a first water level H1 at which the amount of water is large corresponding to much laundry, and a second water level H2 which is the minimum water level at the time of washing, that is, at which the amount of water is small corresponding to little laundry are set.

Although at the second water level H2, the center position of a rotary axis 46 which is a center axis of the pulsator 122 is approximately intermediate between the bottom 121a and the water level H2, the upper part of the pulsator 122 is below the water level H2. The upper part of the pulsator 122 is below the water level H2 which is the minimum water level at the time of washing, and is not projected above the surface of water. Even if the pulsator 122 is rotated at the time of washing, therefore, it does not splash the water. Therefore, it is possible to reliably prevent the water from being splashed.

Furthermore, at the first water level H1, the center position of the rotary axis 46 is below a position intermediate between the bottom 121a and the water level H1. Consequently, the projections 122b of the pulsator 122 are arranged in a lower position in the washing tub 121, as compared with that in a case where the rotary axis 46 is above the intermediate position. As a result, it is difficult for the projections 122b to prevent the laundry from being taken out, whereby the laundry can be smoothly taken out.

Particularly, the pulsator 122 is close to the bottom surface 121a as described above, and has a small outer diameter. Therefore, it is more difficult for the projections 122b to prevent the laundry from being taken out, whereby the laundry can be more smoothly taken out.

A driving mechanism 43 for driving the pulsator 122 is provided along the outside of the lower portion 121h of the long side 121b of the washing tub 121. The lower portion 121h of the long side wall 121b on which the pulsator 122 is provided is projected toward the surface of the pulsator 122, as compared with the upper portion 121f. Therefore, the lower portion 121h is more recessed than the upper portion 121f outside the washing tub 121. A projected portion of the driving mechanism 43, for example, a left end of the rotary axis 46 is so provided as to be less projected than a left end (an outer side-face of the upper portion 121f) of the washing tub 121. Consequently, the washing tub 121 can be arranged, close to a washing tub 21, as in the second embodiment. Therefore, it can be easy to move the laundry between the washing tub 21 and the washing tub 121, whereby the washing machine can be made more convenient of use. Further, the driving mechanism 43 is less projected than the outer side-face of the washing tub 121, whereby the external dimensions of the sub-washing unit 120 can be decreased, and the external dimensions of the cabinet 100 can be decreased.

The lower portion 121*h* of the long side wall 121*b* may not be recessed to such a degree that the left end of the rotary axis 46 is less projected than the left end of the washing tub 121, as compared with the upper portion 121*f*. Also in this case, the amount of projection of the projected portion of the driving mechanism 43 can be decreased depending on the amount of recess. Correspondingly, the washing tub 121 can be brought near the washing tub 21, and the external dimensions of the cabinet 100 can be decreased.

According to the present embodiment, therefore, the sub-washing machine 120 is arranged on the right side, the pulsator 122 is positioned below the portion intermediate between the bottom 121*a* and the defined water level H1, the pulsator 122 is close to the bottom 121*a*, the outer diameter of the pulsator 122 is small, and the width W1 of the upper part of the washing tub 121 is made larger than the width W2 of the lower part thereof, whereby the laundry can be taken out more smoothly. Consequently, the washing machine can be made more convenient of use.

Figures 6A, 6B:
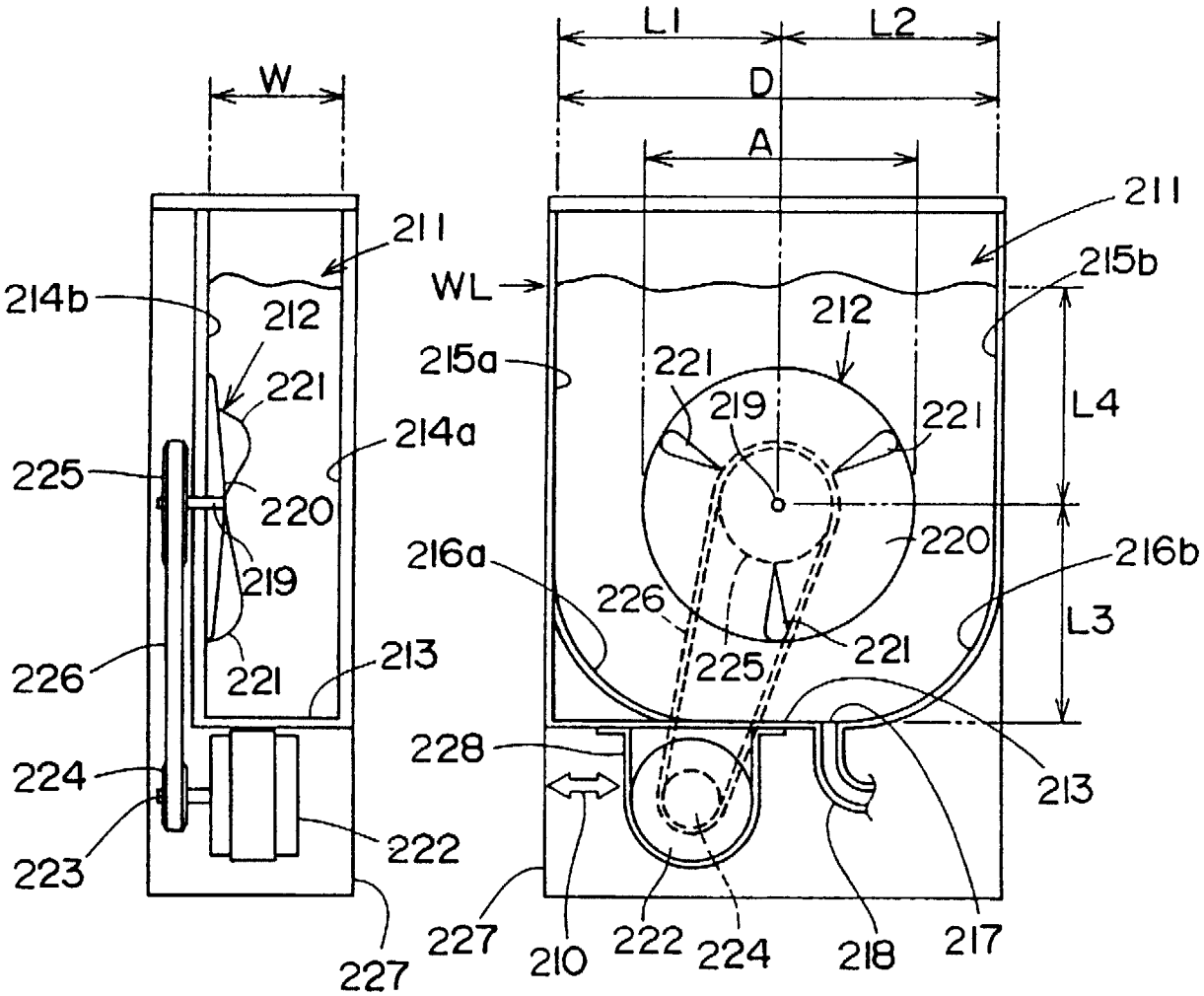
FIGS. 6(*a*) and 6(*b*) are illustrations showing the construction which characterizes a washing machine according to a third embodiment of the present invention.

FIGS. 6(*a*) and 6(*b*) are illustrations showing the construction which characterizes a washing machine according to a third embodiment of the present invention, where FIG. 6(*a*) illustrates the construction as viewed from the front, and FIG. 6(*b*) illustrates the construction as viewed from the right side.

The washing machine comprises a washing tub 211 whose plane shape is an approximately rectangular inner shape and a pulsator 212 provided in the washing tub 211.

The washing tub 211 is a tub for containing wash water and laundry, and has a bottom 213 and four side walls raised from the circumference of the bottom 213. The side walls comprise a pair of long side walls 214*a* and 214*b* positioned at the front and the back as viewed from the right side, and a pair of short side walls 215*a* and 215*b* positioned on the left and right sides as viewed from the front. The width of the long side walls 214*a* and 214*b* is taken as D, and the width of the short side walls 215*a* and 215*b* is taken as W. Therefore, the plane shape of the washing tub 211 is an approximately rectangular inner shape comprising a pair of long sides D defined by the pair of long side walls 214*a* and 214*b* and a pair of short sides W defined by the pair of short side walls 215*a* and 215*b*.

Furthermore, connecting portions 216*a* and 216*b* between the bottom 213 and the short side walls 215*a* and 215*b* are recessed and curved surfaces. When the wash water and the laundry are agitated by the pulsator 212, therefore, the rotation of the wash water and the laundry is smoothed.

The curvature of the recessed and curved surfaces of the connecting portions 216*a* and 216*b* between the bottom 213 and the short side walls 215*a* and 215*b* can be subjected to various changes by the design. The connecting portions 216*a* and 216*b* may not be recessed and curved surfaces as in the present embodiment, as the case may be.

Furthermore, although connecting portions between the bottom 213 and the long side walls 214*a* and 214*b* cross each other at approximately right angles in the present embodiment (see FIG. 6(*a*)), the connecting portions between the bottom 213 and the long side walls 214*a* and 214*b* may be recessed and curved surfaces.

Since the washing tub 211 comprising the bottom 213, the long side walls 214*a* and 214*b*, and the short side walls 215*a* and 215*b* is generally integrally formed of resin, a stainless plate, or the like, it is easy to bring the connecting portions between the bottom and the side walls into recessed and curved surfaces.

A drainage port 217 is formed on the bottom 213, and a drainage pipe 218 is connected to the drainage port 217. The drainage pipe 218 is provided with a valve (not shown). When the valve is opened, the wash water in the washing tub 211 is drained. When the valve is closed, the wash water can be accumulated in the washing tub 211.

A defined water level WL is further set in the washing tub 211. The wash water is generally accumulated to the defined water level WL.

The pulsator 212 provided in the washing tub 211 has a disk 220 rotated or turned around its center axis 219, and a plurality of (three in the present embodiment) projections 221 provided on the surface of the disk 220. The pulsator 212 is so provided on the long side wall 214*b* of the washing tub 211 that the center axis 219 is perpendicular to the long side wall 214*b*. That is, the pulsator 212 is longitudinally arranged.

In the present embodiment, the diameter A of the disk 220 of the pulsator 212 is so set that W<A, as compared with the width D of the long side walls 214*a* and 214*b* and the width W of the short side walls 215*a* and 215*b*. In other words, the diameter of the pulsator 212 is so set as to be relatively large. The pulsator 212 is large-sized one capable of satisfactorily agitating the wash water and the laundry in the washing tub 211.

Furthermore, the projections 221 are respectively projections which are slightly long in the radial direction of the disk 220, and the height thereof from the surface of the disk 220 is made larger on the side of the circumference of the disk 220. Consequently, the pulsator 212 rotated around the center axis 219 produces an agitating force which is stronger on the outside thereof. Therefore, the pulsator 212 can produce a strong agitating force in its outer peripheral portion while decreasing the diameter of the pulsator 212 (the diameter of the disk 220). Although the pulsator 212 is provided on the one long side wall 214*b* as described above, the arrangement position thereof is as follows. Specifically, the pulsator 212 is so arranged that the center axis 219 is positioned in the vicinity of the center between the bottom 213 and the defined water level WL in the height direction of the long side wall 214*b*. Consequently, the distance L3 from the center axis 219 to the bottom 213 and the distance L4 from the center axis 219 to the defined water level WL are set to L3≐L4.

Consequently, the wash water and the laundry in the washing tub 211 are efficiently rotated or turned around the pulsator 212, whereby the washing effect is improved.

Furthermore, the pulsator 212 is so arranged that the center axis 219 is positioned in the center of the long side wall 214*b* as horizontally viewed. That is, referring to FIG. 6(*b*), the distance L1 from the one short side wall 215*a* to the center axis 219 of the pulsator 212 and the distance L2 from the other short side wall 215*b* to the center axis 219 are set to L1≐L2.

Additionally, the above-mentioned distances L1 to L4 are more preferably set to L1≐L2≐L3≐L4. Consequently, the wash water and the laundry in the washing tub 211 are uniformly rotated or turned by the pulsator 212, whereby the washing machine can be increased in the efficiency of washing.

The washing machine is further provided with a driving mechanism for rotating or turning the pulsator 212. The driving mechanism comprises a motor 222, a small pulley 224 fixed to an output shaft 223 of the motor, a belt 226 for transmitting the rotation of the small pulley 224, and a large pulley 225 rotated by the belt 226.

The large pulley 225 is arranged concentrically with the center axis 219 of the pulsator 212, and is fixed to the center axis 219. Specifically, the center axis 219 of the pulsator 212 has its part passing through the long side wall 214*b* in a direction perpendicular to the long side wall 214*b*, and extends outward from the washing tub 211. The large pulley 225 is fixed to the extending center axis 219. A portion, through which the center axis 219 passes, of the long side wall 214*b* is provided with a bearing for rotatably receiving the center axis 219, a sealing member for preventing the wash water in the washing tub 211 from leaking outward through the passing portion, and the like, which are not illustrated.

The driving mechanism in the washing machine shown in FIGS. 6(*a*) and 6(*b*) is characterized in that the motor 222 is mounted on the lower side of the bottom of the washing tub 211. When the motor 222 is mounted not on the bottom of a cabinet 227 of the washing machine but on the lower side of the bottom of the washing tub 211 as described above, there are the following advantages.

That is, when the wash water is put in the washing tub 211, the washing tub 211 slightly extends due to the weight of the wash water, whereby the bottom 213 thereof extends downward. Since the washing tub 211 is made of a material such as resin or a stainless plate as described above, the downward extension thereof cannot be avoided in terms of the characteristics of the material. If the motor 222 is mounted on the lower side of the bottom of the washing tub 211, the bottom 213 of the washing tub 211 slightly extends downward, whereby the motor 222 is slightly displaced downward. The displacement of the motor 222 increases the tension of the belt 226 stretched between the small pulley 224 and the large pulley 225. Therefore, the tension of the belt 226 is increased at the time of washing, whereby the belt 226 hardly slips between the small pulley 224 and the belt 226 or between the large pulley 225 and the belt 226. Consequently, torque produced by the motor 222 is efficiently transmitted, so that the pulsator 212 is rotated.

Furthermore, when the motor 222 is mounted on the lower side of the bottom of the washing tub 211, it is easy to adjust the tension of the belt 226. The motor 222 is made displaceable, as indicated by a hollow arrow 210 in FIG. 6(*b*), along the bottom 213 of the washing tub 211. Consequently, the tension of the belt 226 can be increased if the motor 222 is displaced leftward, while the tension of the belt 226 can be decreased if the motor 222 is moved rightward.

The specific mounting structure of the motor 222 on the lower side of the bottom of the washing tub 211 can be realized by a mounting frame 228 and a machine screw. In this case, a long hole which is long in a direction as indicated by the hollow arrow 210 is formed on the lower side of the mounting frame 228 or the bottom of the washing tub 211 so that the machine screw is engaged with the long hole. Consequently, the motor 222 can be displaced in the direction indicated by the hollow arrow 210 within the range of the length of the long hole.

As for the mounting structure of the motor 222 on the lower side of the bottom of the washing tub 211, the motor 222 can be so mounted as to be displaceable in the direction indicated by the hollow arrow 210 by utilizing the known mounting structure.

Figure 7B:
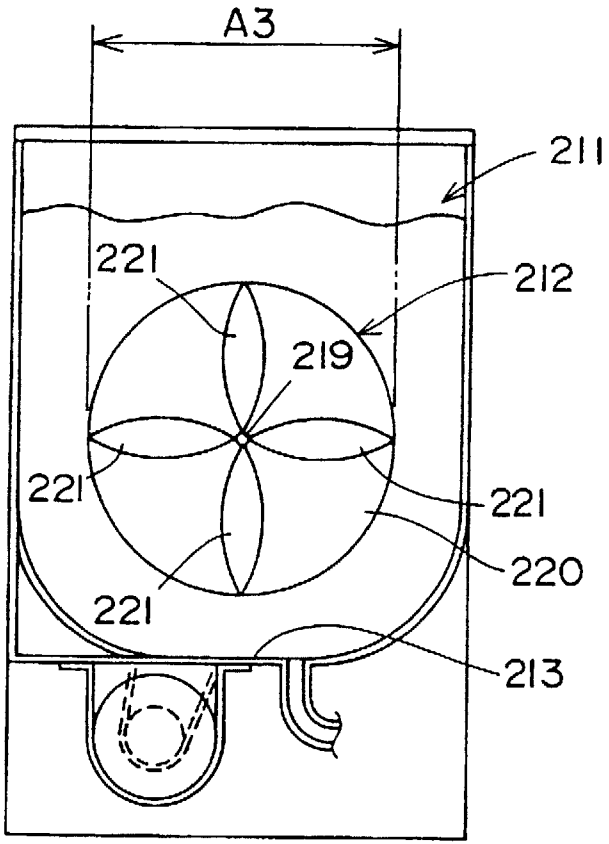
FIGS. 7(*a*) and 7(*b*) are illustrations showing the construction which characterizes a washing machine according to a fourth embodiment of the present invention.
Figure 7A:
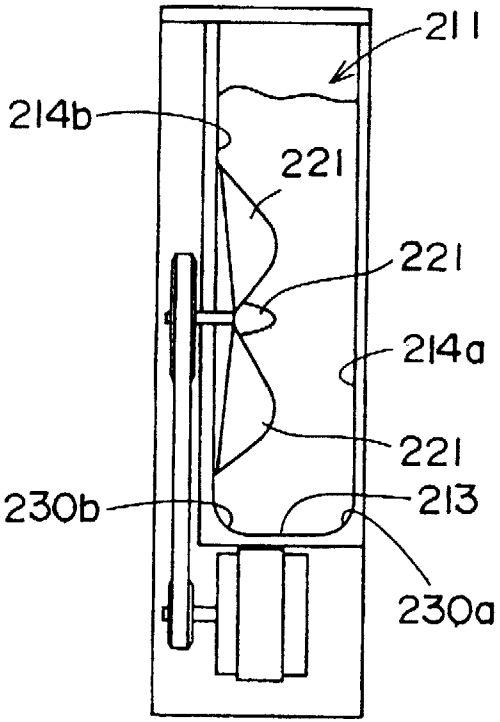

FIGS. 7(*a*) and 7(*b*) are illustrations showing the construction of a washing machine according to a fourth embodiment of the present invention, where FIG. 7(*a*) illustrates the construction as viewed from the front, and FIG. 7(*b*) illustrates the construction as viewed from the right side, similarly to FIG. 6(*b*).

The washing machine shown in FIGS. 7(*a*) and 7(*b*) differs in the construction of a pulsator 212, as described below, from the washing machine described while referring to FIGS. 6(*a*) and 6(*b*). Further, connecting portions between a bottom 213 and long side walls 214*a* and 214*b* of a washing tub 211 are recessed and curved.

The other construction is the same as that of the washing machine described while referring to FIGS. 6(*a*) and 6(*b*) and hence, the overlapped description is not repeated.

Referring to FIG. 7(*b*), the diameter of the pulsator 212, that is, the diameter A3 of a disk 220 is made larger than the diameter A of the disk 220 in the washing machine described while referring to FIG. 6(*b*). That is, A3>A. This is for increasing the dimensions of the pulsator 212 and enhancing detergency. The pulsator 212 is provided with four projections 221 radially around its center axis 219. Each of the projections 221 is a projection extending toward the center axis 219 from the circumference of the disk 220, and is formed in such a shape that the height thereof from the surface of the disk 220 is gradually increased and gradually decreased from the circumference to the center axis. If the projections 221 are formed in such a shape, efficient rotating flow occurs when the disk 220 is rotated, whereby wash water and laundry can be satisfactorily agitated.

Furthermore, connecting portions 230*a* and 230*b* between the bottom 213 and the long side walls 214*a* and 214*b* of the washing tub 211 are recessed and curved. Consequently, the wash water and the laundry can be rotated more smoothly.

The washing tub 211 in which the connecting portions 230*a* and 230*b* are recessed and curved as shown in FIG. 7(*a*) may be also applied to the washing machine shown in FIGS. 6(*a*) and 6(*b*).

Figure 8B:
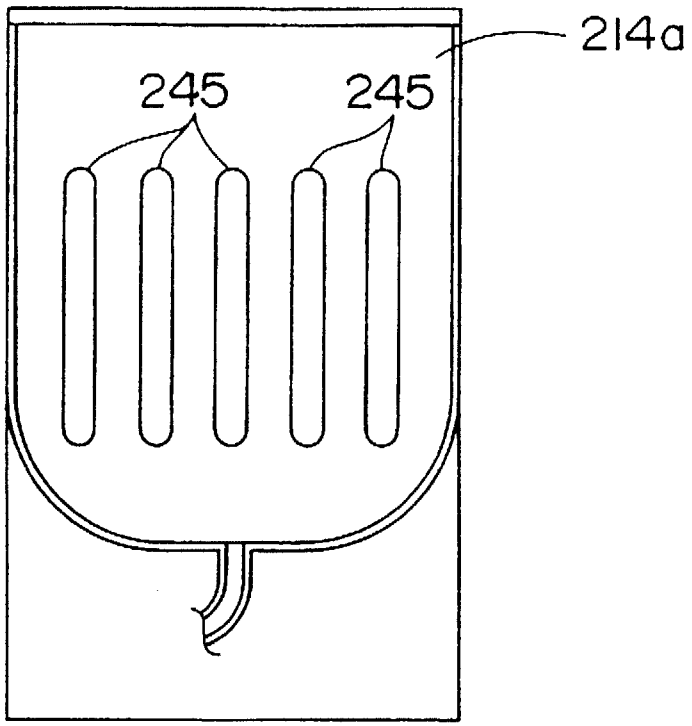
FIGS. 8(*a*) and 8(*b*) are diagrams showing a modified example of the shape of a side wall of a washing tub which is applicable to the washing machine according to the present invention.
Figure 8A:
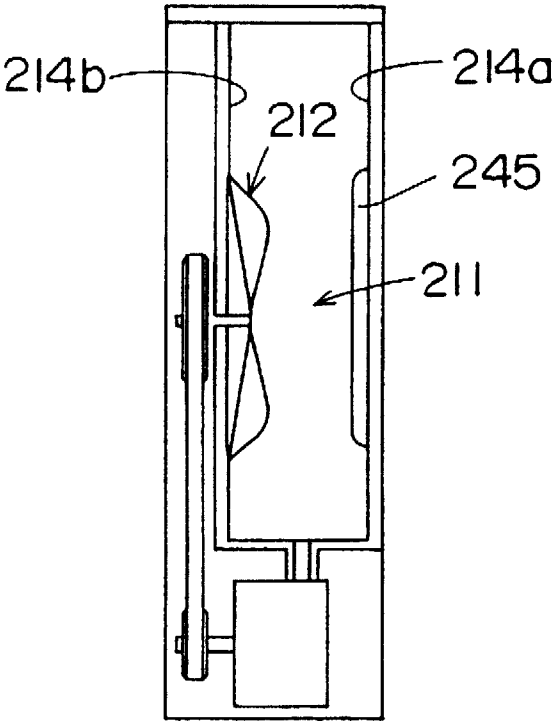

FIGS. 8(*a*) and 8(*b*) are diagrams showing an embodiment in which a long side wall 214*a* on which a pulsator 212 is not provided out of a pair of long side walls 214*a* and 214*b* is improved, where FIG. 8(*a*) illustrates the construction as viewed from the front, and FIG. 8(*b*) illustrates the construction as viewed from the left side.

As shown in FIGS. 8(*a*) and 8(*b*), a plurality of projections 245 extending in the longitudinal direction are formed on the long side wall 214*a*. When the long side wall 214*a* is horizontally viewed, therefore, the surface of the long side wall 214*a* is provided with irregularities.

According to such construction, laundry rotated in a washing tub 211 is rubbed against the irregularities formed on the long side wall 214*a*, resulting in an improved washing effect. Further, the projections 245 on the long side wall 214*a* extend in the longitudinal direction. When the entire washing tub 211 is integrally formed of resin, for example, punching is easy. The projections 245 may be replaced with recesses.

In addition to the foregoing embodiments, a washing tub in an approximately rectangular plane shape comprising the pulsator 212 in the present invention can be also combined with the conventional fully automatic washing machine.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A washing machine comprising:

a washing tub having a bottom and side walls raised from the circumference of the bottom for containing wash water and laundry; and a pulsator provided in the washing tub and having a disk rotatable about a center axis thereof and projections provided on a surface of the disk for agitating the wash water and the laundry, the washing tub having a pair of long side walls and a pair of short side walls, and a plane shape being an approximately rectangular inner shape comprising a pair of long sides having a length D defined by the pair of long side walls and a pair of short sides having a length W defined by the pair of short side walls, the pulsator being so provided on one of the pair of long side walls that the center axis is perpendicular to the long side wall, the diameter A of the disk of the pulsator being so set that W<A, each projection of the pulsator being elongated on the disk along a radial direction of the disk, each projection having height from the surface of the disk that is relatively lower in the vicinity of the center axis and relatively higher at portions remote from the center axis.

2. The washing machine according to claim 1, wherein the projections of the pulsator are respectively projections directed toward the center axis from the circumference of the disk, and are formed in such that their height from the surface of the disk gradually increases and then gradually decreases from the circumference of the disk toward the center axis.

3. The washing machine according to claim 1, wherein a defined water level for defining the amount of wash water accumulated in the washing tub is set, and the pulsator is so provided that the center axis is positioned in the vicinity of the center between the bottom and the defined water level in the height direction on the one long side wall.

4. The washing machine according to claim 3, wherein the dimensions of the washing tub are so set that a length along the one long side wall on which the pulsator is provided from one end of the one long side wall as horizontally viewed to the center axis of the pulsator is approximately equal to a length from the other end of the one long side wall as horizontally viewed to the center axis of the pulsator.

5. The washing machine according to claim 1, wherein a connecting portion between the bottom and the short side wall of the washing tub is a recessed and curved surface.

6. The washing machine according to claim 5, wherein a connecting portion between at least the other long side wall, on which the pulsator is not provided, out of the pair of long side walls and the bottom is a recessed and curved surface.

7. The washing machine according to claim 1, wherein a plurality of recesses or projections extending in the longitudinal direction are formed on the other long side wall, on which the pulsator is not provided, out of the pair of long side walls.

8. The washing machine according to claim 1, wherein a drainage port for draining the wash water in the washing tub is formed in the lowermost part of the bottom.

9. The washing machine according to claim 1, wherein the pulsator has its center axis passing through the long side wall in a direction perpendicular to the long side wall, a pulley rotatably provided coaxially with the center axis of the pulsator extending outward from the washing tub after passing through the long side wall is connected to the center axis, a motor having an output shaft is mounted on the lower side wall of the bottom of the washing tub, and a belt for transmitting the rotation of the output shaft of the motor to the pulley is stretched between the output shaft and the pulley.

10. The washing machine according to claim 9 wherein the motor is slidably provided along the bottom of the washing tub, and the position where the motor is mounted is displaced along the bottom, to change the distance between the output shaft and the pulley so that the tension of the belt is adjustable.

11. The washing machine according to claim 1, further comprising, in addition to a first washing unit having the washing tub and the pulsator, a second washing unit arranged adjacent to the first washing unit and comprising a washing tub for containing wash water and laundry, and a cabinet containing the first washing unit and the second washing unit.

12. The washing machine according to claim 11, wherein the second washing unit is arranged adjacent to the long side wall, on which the pulsator is provided, of the first washing unit.

13. The washing machine according to claim 11, wherein the second washing unit is arranged adjacent to the long side wall on the opposite side of the long side wall, on which the pulsator is provided, of the first washing unit.

14. The washing machine according to claim 11, wherein a protecting member which can be brought into contact with the second washing unit and is not brought into contact with the first washing unit is further provided between the first washing unit and the second washing unit in the cabinet.

15. The washing machine according to claim 11, wherein the washing tub in the second washing unit is so constructed as to be rotated with the laundry and the wash water contained therein, and comprises a plurality of suspension bars for mounting the washing tub in the second washing unit on the cabinet, a portion, which is mounted on the cabinet, of the suspension bar being closer to the first washing unit than a portion, which is closest to the second washing unit, of the first washing unit.

16. The washing machine according to claim 11, wherein the washing tub in the second washing unit is so constructed as to have in its upper part an opening larger than the opening in the upper part of the first washing unit, the first washing unit being arranged on the right side in the cabinet as viewed from the front surface of the cabinet.

* * * * *